US005931100A

United States Patent [19]

Sutton et al.

[11] Patent Number: 5,931,100

[45] Date of Patent: Aug. 3, 1999

[54] TRACK-SUPPORTED PLAYGROUND SHUTTLE

[75] Inventors: Wesley D. Sutton, Fort Payne; Brian Henry, Rainsville, both of Ala.

[73] Assignee: Newco, Inc., Ft. Payne, Ala.

[21] Appl. No.: 08/988,306

[22] Filed: Dec. 10, 1997

[51] Int. Cl.[6] ..... A63G 1/00

[52] U.S. Cl. ..... 104/53; 104/93; 105/150

[58] Field of Search ..... 104/53, 93, 113, 104/115, 118, 126; 105/149.1, 149.2, 150; 188/67, 174, 179

[56] References Cited

U.S. PATENT DOCUMENTS

| | | | |
|---|---|---|---|
| 801,700 | 10/1905 | Welp . | |
| 1,392,719 | 10/1921 | Swaim | 105/150 |
| 1,859,180 | 5/1932 | Thiel . | |
| 1,935,711 | 11/1933 | Hecox et al. | 104/113 |
| 1,958,877 | 5/1934 | Yake | 104/113 |
| 2,819,755 | 1/1958 | Berger et al. . | |
| 3,026,816 | 3/1962 | Russo et al. . | |
| 3,070,035 | 12/1962 | Russo et al. . | |
| 4,062,293 | 12/1977 | Davis . | |
| 4,159,113 | 6/1979 | Callecod . | |
| 4,948,118 | 8/1990 | Miraglia . | |
| 5,468,199 | 11/1995 | Keeler et al. . | |
| 5,816,167 | 10/1998 | Danforth et al. | 104/53 |

FOREIGN PATENT DOCUMENTS

| | | | |
|---|---|---|---|
| 3705-775-C | 3/1988 | Germany . | |
| 3705775C1 | 3/1988 | Germany | 105/150 |
| WO80/02402 A1 | 11/1980 | WIPO . | |

*Primary Examiner*—Mark T. Le
*Assistant Examiner*—Robert J. McCarry, Jr.
*Attorney, Agent, or Firm*—Welsh & Katz, Ltd.

[57] ABSTRACT

A playground shuttle device includes a track having an upper surface and a lower surface and a support structure connected to and supporting the track. The shuttle device includes a shuttle having a housing defining a chamber through which the track traverses and a transport assembly carried by the housing. The transport assembly includes a plurality of wheels rotatably mounted thereto and positioned so as to ride along the upper surface of the track. The transport assembly includes a brake assembly operably connected thereto by a biasing element. The brake assembly includes at least one brake element that is engagable with the track. The brake assembly is movable relative to the transport assembly between a brake position wherein the brake element engages the track and a free-roll position wherein the brake element is disengaged from the track. When a force is applied to the brake assembly against the biasing element, the brake elements are disengaged from the track to move the shuttle to the free-roll position. Removal of the force from the brake assembly engages the brake element with the track to move the shuttle to the brake position.

18 Claims, 3 Drawing Sheets

TRACK-SUPPORTED PLAYGROUND SHUTTLE

FIELD OF THE INVENTION

The present invention pertains to a playground shuttle device that rides along a support track. More particularly, the present invention pertains to a self-stopping or easily stopped playground shuttle device for supporting children riding the shuttle along a track.

BACKGROUND OF THE INVENTION

Playgrounds can be found in most every city coast-to-coast. Although the type of equipment can vary considerably from one playground to the next, a common objective or goal of all playground equipment is to provide a safe, fun and entertaining atmosphere for children of all ages.

One of the most entertaining playground devices is a shuttle or like sliding device. A typical shuttle-like device includes a track that is generally horizontal and a sliding device from which a child can hang and move back and forth along the track. Such shuttle devices not only provide dynamic movement and entertainment for the child, but can also foster physical development in that children will hang from such a device and often exercise their arms by pulling themselves up and down from the device.

One known shuttle device includes a track and a trolley that rides along the track. The trolley has a handle suspended therefrom by a chain. The trolley can include bumpers on either end or bumpers can be located at the ends of the track to absorb some of the shock of the trolley striking the end of the track. One drawback to such a shuttle device is that it lacks any capability for the child or shuttle user to brake or slow down the shuttle as it approaches one of the ends of the track or anywhere along the middle section of the track.

One known device attempts to alleviate the braking problem by including a hand brake that is actuated by, for example, a brake handle and cable. However, as will be recognized by those skilled in the art, this type of hand brake requires the user to apply pressure, as by a hand, on the brake handle in order to activate the brake. Often, this requires the user to "hang" from the shuttle by a single hand while actuating the brake with the other hand.

Another device includes a cantilevered handle assembly and a pair of pivot arms. The cantilevered handle assembly has a horizontally positioned spring that urges the cantilever assembly into contact with the cable to brake or slow the shuttle device. Although this device overcomes some of the drawbacks of the known brakeless and hand-actuated brake assembly devices, it appears that considerable force would be required in order to apply the brake while moving. Accordingly, there continues to be a need for a playground shuttle device that includes a brake that can be easily applied by the child as the child is riding the shuttle device. Such a brake can be readily actuated without the child removing a hand from the shuttle handles or handholds.

SUMMARY OF THE INVENTION

A children's playground shuttle device includes a track having an upper surface and a lower surface, a support structure connected to and supporting the track and a shuttle for traversing along the track. The shuttle includes a housing defining a chamber through which the track traverses and a transport assembly carried by the housing within the chamber. The transport assembly includes a plurality of wheels rotatably mounted thereto and positioned so as to ride along the upper surface of the track.

A brake assembly is carried by the transport assembly and includes at least one brake element that is engagable with the track lower surface. The brake element is mounted to the transport assembly by a biasing element. The brake assembly is movable relative to the transport assembly between a brake position wherein the brake element engages the track lower surface and a free-roll position wherein the brake element is disengaged from the track lower surface.

A downward force applied to the brake assembly against the biasing element disengages the brake element from the track lower surface to move the shuttle to the free-roll position. Conversely, when the downward force is removed from the brake assembly, the biasing element moves the brake element into contact or engagement with the lower surface of the track to move the shuttle into the brake position.

Preferably the shuttle includes at least one handle mounted thereto, and most preferably a pair of handles mounted to the shuttle. In a most preferred embodiment the handles are mounted to the transport assembly and preferably the handles are mounted directly to the brake assembly.

The shuttle housing can include a plurality of openings therein for receiving the handles so that the handles move in a reciprocating manner as the brake assembly is engaged and disengaged. In a most preferred embodiment of the transport assembly, the transport assembly includes two pairs of wheels mounted thereto, each pair of wheels being spaced from one another longitudinally in a direction of travel of the shuttle and each wheel of each pair being spaced from one another so as to ride along the track upper surface spaced from one another.

Preferably, the brake assembly includes a brake element that engages the track at about the lower surface thereof. In a most preferred embodiment, two brake elements are spaced from one another and spaced outwardly of the wheels, and each is independently engagable with the track lower surface.

An alternate embodiment of the shuttle includes three pairs of wheels wherein one of the pairs is mounted so as to ride along the track lower surface. The lower wheel maintains the upper wheels fully in engagement with the upper surface of the track. In a most preferred embodiment of the shuttle, the biasing elements that operably connect the brake assemblies to the transport assembly are coil springs.

Other features and advantages of the present invention will be apparent from the following detailed description, the accompanying drawings, and the appended claims.

DETAILED DESCRIPTION OF THE PREFERRED EMBODIMENTS

Figure 1:
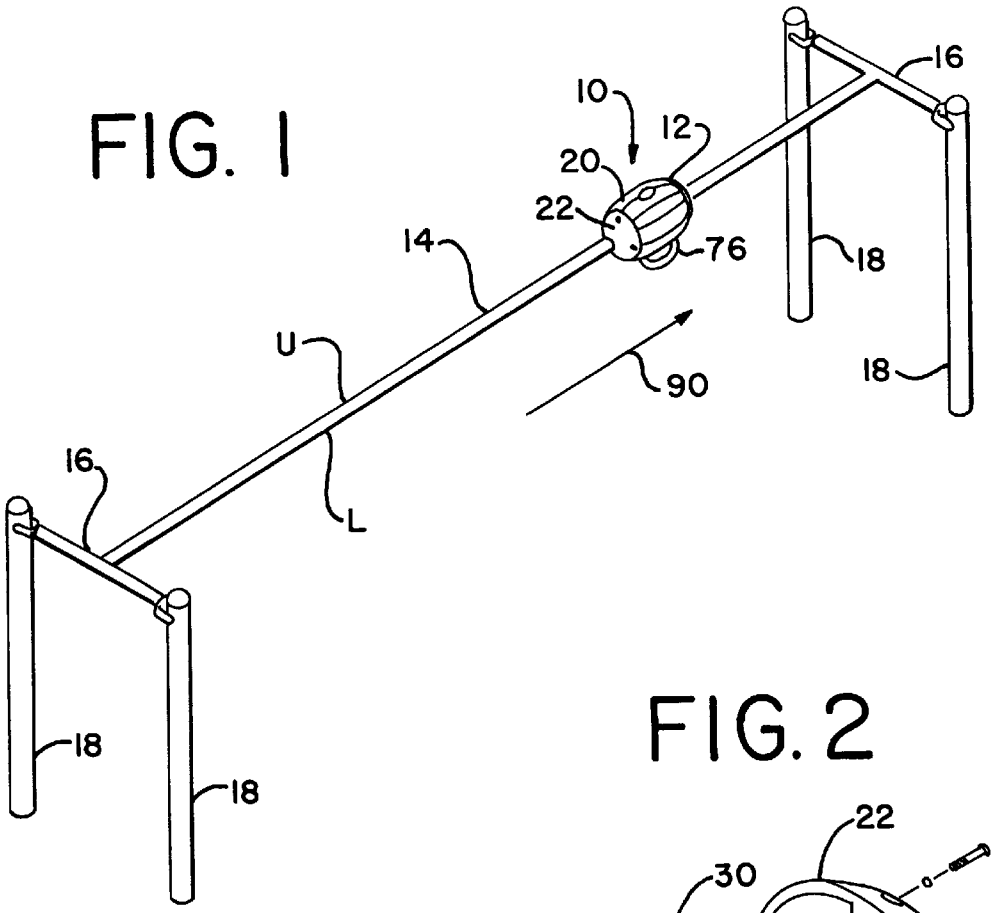
FIG. 1 is a perspective illustration of a shuttle device embodying the principles of the present invention, illustrated positioned on a track supported at both ends of the track.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to FIG. 1 there is shown a playground shuttle equipment assembly 10 that includes a shuttle device 12 in accordance with the principles of the present invention. The equipment assembly 10 includes a track 14 along which the shuttle device 12 rides. The track 14 is typically supported at both ends by end supports 16. The end supports 16 can each include a pair of support posts 18 at each end spaced from one another to provide an opening at about where the shuttle 12 terminates along the track 14.

Figure 2:
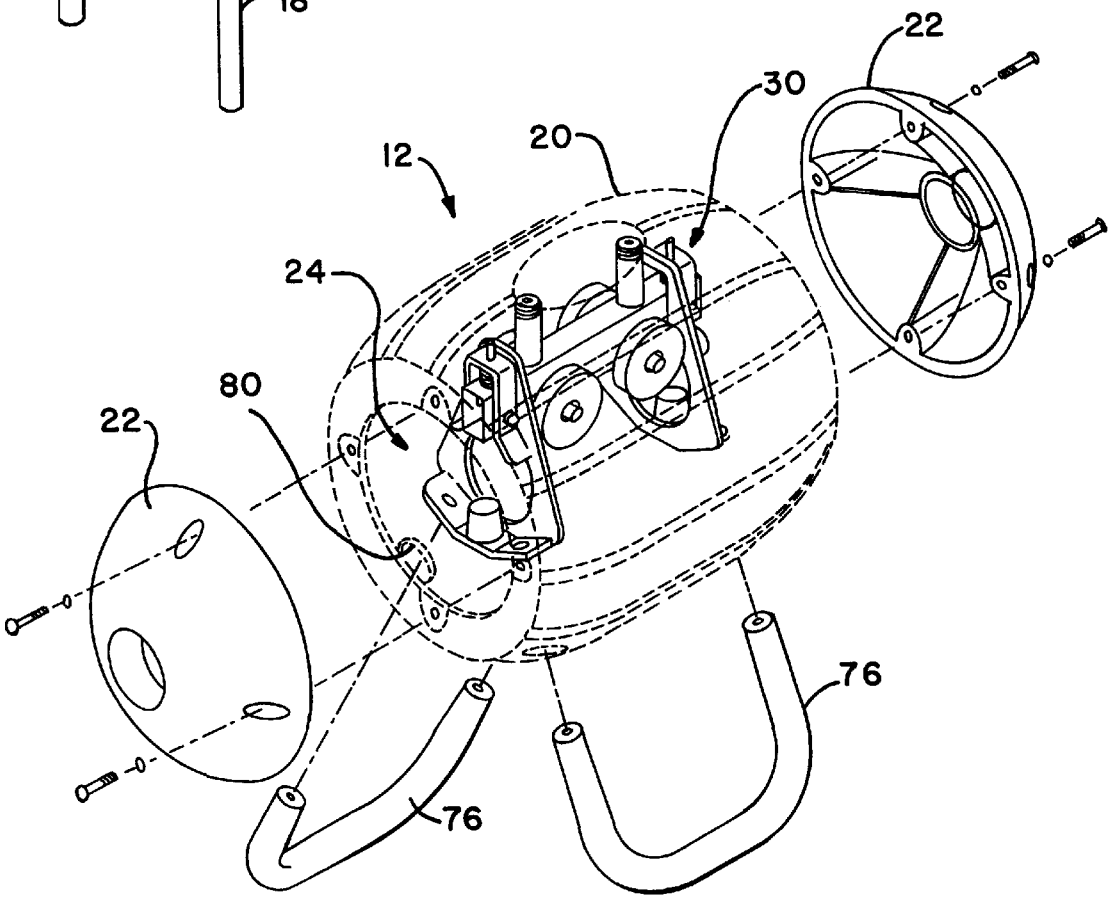
FIG. 2 is a perspective view of the shuttle device, the device being shown in a partially exploded view, with the housing thereof illustrated in phantom lines.
Figure 3:
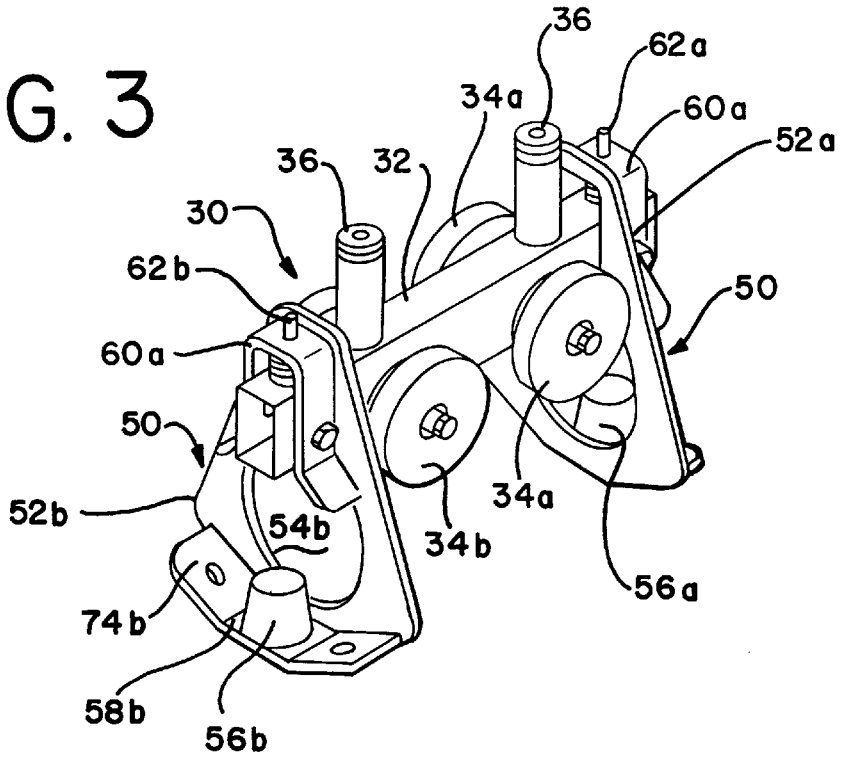
FIG. 3 is a perspective view of the transport assembly of the shuttle device of FIG. 2 shown in an assembled manner.

The shuttle device 12 is best seen in FIG. 2, in which a housing 20 is shown in phantom lines. The housing 20 can be formed having a wide variety of shapes and configurations, such as the exemplary barrel-shaped housing 20. The housing 20 can include end caps 22 to enclose the interior 24 of the housing 20 to enhance the aesthetics and safety of the shuttle 12. The shuttle device 12 includes a transport assembly 30 carried by the housing 20. The transport assembly 30 is shown mounted within the housing 20 in FIG. 2, is shown with the housing 20 removed in FIG. 3 and is shown in an exploded view in FIG. 4.

In a present embodiment, the transport assembly 30 includes a chassis frame 32 and a plurality of wheels 34 mounted to the chassis frame 32. The housing 20 is mounted to the chassis frame 32 by one or more housing mounts 36. The wheels 34 are mounted to the chassis frame 32 by an axle 38 and include spacers or bushings 40 and bearings 42 so that the wheels spin freely about the axle 38. In a contemplated embodiment the transport assembly 30 includes two pairs of wheels 34*a*, 34*b* mounted opposingly about the chassis 32. The wheels 34 are fixedly positioned along the axle 38 relative to one another such that the space or distance between the wheels 34 remains fixed. In this manner, the wheels 34 remain on the track 14 rather than separating and thus allowing the chassis frame 32 to contact the track 14.

Figure 4:
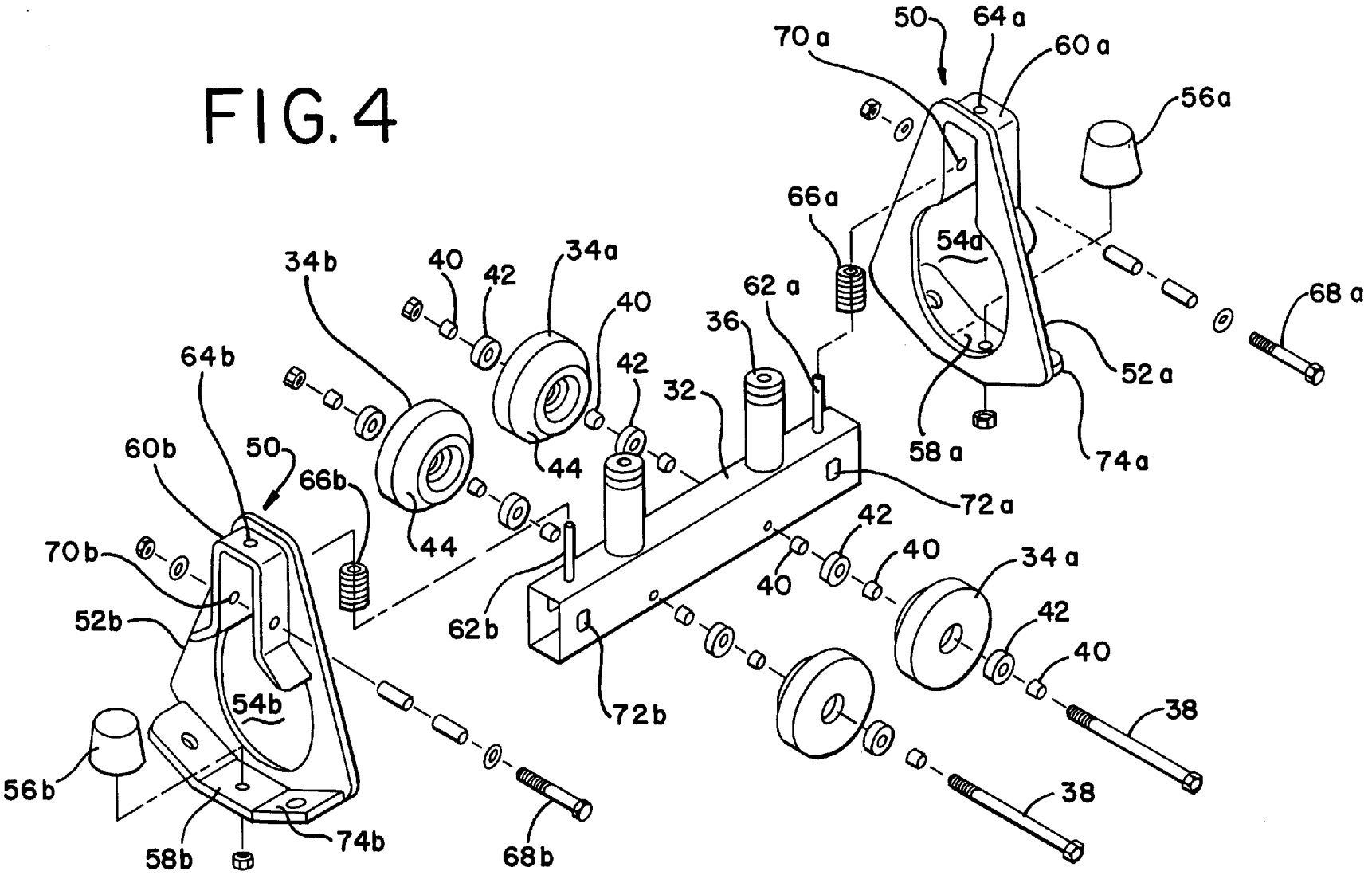
FIG. 4 is an exploded, perspective view of the transport assembly including the brake assembly of FIG. 3.

As is best seen in FIG. 4, the wheels 34 can include a beveled edge as indicated at 44. The beveled edge 44 facilitates the wheels 34 and thus the transport assembly 30 remaining centered on the track 14. This further precludes the transport assembly 30 from shifting side-to-side when in use. As will be understood by those skilled in the art, other wheel 34 configurations can be used to maintain the transport assembly 30 centered on the track 14, which other wheel configurations are within the scope of the present invention.

The chassis 32 is configured to ride above the upper surface U of the track with the wheels 34 resting along the track upper surface U. It will be apparent from the drawings that the wheels rest on the track 14 on the upper surface U generally above a horizontal centerline thereof It will be recognized by those skilled in the art that a single wheel having an arcuate or curved center portion can be used in lieu of a pair of spaced apart wheels.

The transport assembly 30 includes a brake assembly 50 mounted thereto. The brake assembly 50 includes a pair of endplates 52*a, b* that mount to the chassis 32. Each endplate includes an opening 54*a, b* therethrough, through which the track 14 traverses, and a brake or bumper 56*a, b* mounted to each endplate 52*a, b* on a bottom angled projection or brake mount 58*a, b*. Preferably, the brakes 56*a, b* are formed of an elastic or elastic-like material such as rubber. The endplates 52*a, b* each include an inverted or upside-down U-shaped projection or clip 60*a, b*. The U-shaped clip 60*a, b* extends transversely from an upper portion of the endplates 52*a, b*. The plates 52*a*, are mounted to the chassis 32 at a pair of pins 62*a, b* that extend upwardly from the chassis 32 through openings 64*a, b* formed in the U clips 60*a, b* that receive the pins 62*a, b*. A biasing element, such as the illustrated coil spring 66*a, b* , is positioned over each pin 62*a, b* between the chassis 32 and the U-clips 60*a, b* such that each endplate is mounted to the chassis 32 in a biased manner.

The endplates 52*a, b* are mounted to the chassis 32 independently of one another. This biased arrangement provides for the brakes 56*a, b* to be independently upwardly urged (by the springs 66*a, b*) relative to the wheels 34. The endplates 32*a, b* are further supported on the chassis 32 by bolts 68*a, b* or like fasteners that insert through side openings 70*a, b* in the U-clips 60*a, b* and through notched openings 72*a, b* in the chassis 32. The notched openings 72*a, b* permit the endplates 52*a, b* and the brakes 56*a, b* to move transversely (i.e., up and down) relative to the chassis 32.

The transport assembly 30 can further include mounting plates 74*a, b* preferably extending from the endplates 52*a, b*, adjacent to the brake mounts 58*a, b*, for accommodating handles 76 from which the user can hang when using the shuttle 12. This arrangement provides a direct fastening of the handles 76 to the transport assembly 30, rather than to the shuttle device housing 20.

Referring to FIG. 2, the housing 20 includes openings 80 therein, through which the handles 76 enter the shuttle 12. The handles 76 mount directly to the transport assembly 30, and preferably to the brake assembly 50. In this manner, as will be described in more detail below, the handles 76 and thus the brake assembly 50 are transversely movable relative to the track 14. Thus, the brake assembly 50 and handles 76 are independently transversely movable relative to the chassis 32 and housing 20. However, it will be recognized by those skilled in the art that the handles 76 can be mounted to the shuttle 12 by other mounting configurations, which other mounting configurations are within the scope of the present invention.

Figure 5:
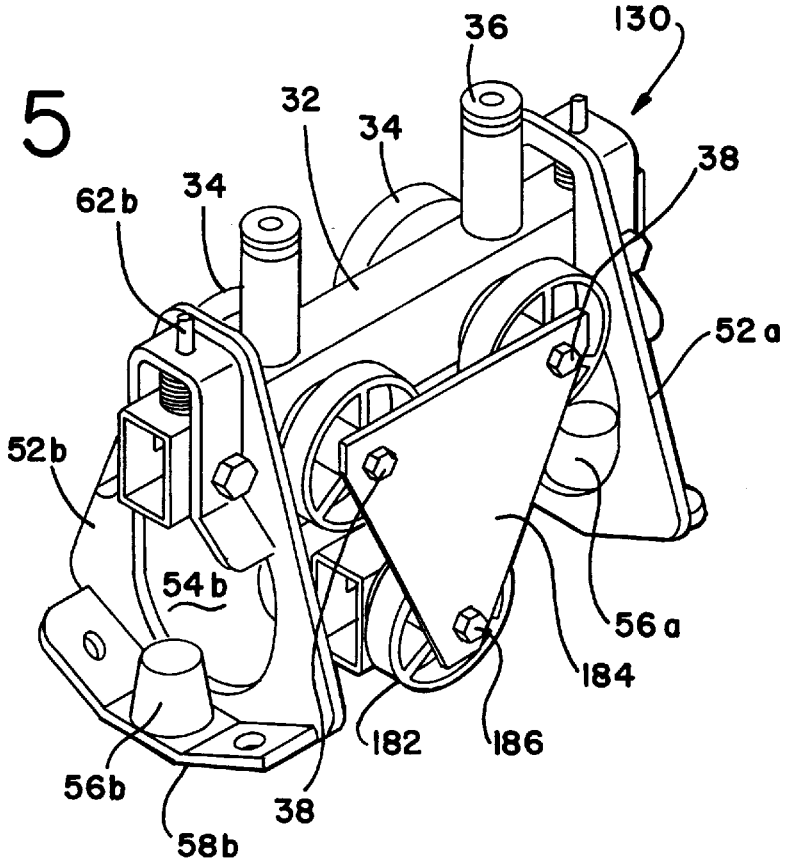
FIG. 5 is a perspective view of an alternate embodiment of the transport assembly.

An alternate embodiment of the transport 130 assembly 10 is illustrated in FIG. 5. In the embodiment of FIG. 5, parts corresponding to those of the embodiment of FIG. 4 are given like numbers to those of FIG. 4. This embodiment includes a lower wheel 182 and preferably a pair of lower wheels 182 positioned in opposing relation to the upper wheels 34 and spaced therefrom. The lower wheels 182 are maintained in position relative to the upper wheels 34 by a wheel mount or wheel plate 184 through which the axles 38, 186 extend. As will be explained in more detail below, the lower wheels 182 engage the lower surface L of the track 14 when the shuttle 12 is in use, to provide additional stability to the shuttle 12 and to maintain contact between the upper wheels 34 and the track upper surface U.

Advantageously, the transport assembly 30, 130 including the brake assembly 50 of the present shuttle device 12 provides a playground shuttle which can be readily slowed or stopped by a child using the device 12, without the child having to remove his or her hands from the shuttle handles 76. In use or operation, referring to FIGS. 1 and 2, the shuttle 12 is positioned with the track 14 traversing through the openings 54*a, b* in the endplates 52*a, b*. The biased brake assembly 50 urges the endplates 52*a, b* upward so that when there is no external force on the brake assembly 50, the brake elements 58*a, b* contact the lower surface of the track 14 while the upper wheels 34 rest on the upper surface U of the track 14. That is, when there is no external weight (e.g., a child hanging from the handles) placed on the shuttle 12, the springs 66*a, b* urge the brakes 58*a, b* into contact with the track lower surface L.

When weight is placed on the shuttle 12, such as by a child hanging from the handles 76, the weight of the child pulling downwardly on the handles 76, and thus downwardly on the endplates 52*a, b*, urges the brakes 58*a, b* downward, out of engagement with the front lower surface L. The shuttle device 12 is thus in the free-roll position, free to slide along the track 14.

If, during use, a child wishes to slow or brake the shuttle 12 somewhere along the track 14 other than at one of the two ends, the shuttle 12 can be slowed by grasping the handles 76 and rocking forward and backward (parallel to the direction of travel as indicated at 90 in FIG. 1) to intermittently engage and disengage the brakes 58*a, b*. In rocking the shuttle, when, for example, the shuttle 12 is rocked forward, the wheels 34 remain engaged with the track upper surface, however, the force of the spring extending between the forward endplate U-clip 60*a* and the chassis 32 in conjunction with the upward force as a result of the rocking motion on the handles 76, brings the forward brake 58*a* into contact with the track lower surface L.

Likewise, when the shuttle 12 is rocked back, the wheels 34 remain engaged with the track upper surface U, however, the force of the spring 60*b* that extends between the rear endplate U-clip 60*b* and the chassis 32 in conjunction with the upward force as a result of the rocking motion on the handles 76, urges the endplate 52*b* upward which brings the rear brake 58*b* into contact with the track lower surface L. Thus, it will be apparent from the above description in view of the drawings, that merely by rocking back and forth on the shuttle handles 76, the shuttle 12 can be slowed or stopped at any point along the track 14.

In the embodiment of FIG. 5, the lower wheels 182 facilitate maintaining the upper wheels 34 fully in contact with the track upper surface 14. Thus, even when the shuttle 12 is rocked back and forth, the upper wheels 34 are maintained in contact with the track 14.

In addition, as described above, when there is no external weight on the shuttle handles 76, the spring 66*a, b* bias is sufficient to move the shuttle 12 into the brake position. Thus, the shuttle can be slowed or stopped either by the above-described rocking motion, or by removing external weight from the shuttle 12.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A playground shuttle device comprising:

a track having an upper surface and a lower surface;

a support structure connected to and supporting the track;

a shuttle having a housing defining a chamber through which the track traverses and a transport assembly carried by the housing within the chamber, the transport assembly including a plurality of wheels rotatably mounted thereto and positioned so as to ride along the upper surface of the track; and a brake assembly carried by the transport assembly and operably connected thereto by a biasing element, the brake assembly including two brake elements spaced from one another and engagable with the track, said braking elements being adjacent to opposite end portions of the shuttle, the brake assembly being movable relative to the transport assembly between a brake position wherein the brake elements engage the track and a free-roll position wherein the brake elements are disengaged from the track, wherein a force applied to the brake assembly against the biasing element disengages the brake elements from the track to move the shuttle to the free-roll position and wherein removal of the force from the brake assembly engages the brake elements with the track to move the shuttle to the brake position.

2. A playground shuttle in accordance with claim 1 including at least one handle mounted to the shuttle.

3. A playground shuttle in accordance with claim 2 including two handles mounted to the shuttle.

4. A playground shuttle in accordance with claim 2 wherein the at least one handle is mounted to the transport assembly.

5. A playground shuttle in accordance with claim 4 wherein the at least one handle is mounted to the brake assembly.

6. A playground shuttle in accordance with claim 2 including two handles mounted to the brake assembly in mirror image relation to one another.

7. The playground shuttle in accordance with claim 6 including a plurality of openings in the housing for receiving the handles extending from the brake assembly to an area external of the housing.

8. The playground shuttle in accordance with claim 1 including two pairs of wheels mounted to the transport assembly, each pair of wheels being spaced from one another longitudinally in a direction of travel of the shuttle, and each wheel of each pair being spaced from one another so as to ride along the track upper surface spaced from one another.

9. The playground shuttle in accordance with claim 1 wherein the brake elements engage the track at about the lower surface.

10. The playground shuttle in accordance with claim 1 wherein the brake elements are spaced outwardly of the wheels.

11. The playground shuttle device of claim 10 wherein the brake elements are independently engagable of the track relative to one another.

12. The playground shuttle in accordance with claim 1 including three pairs of wheels, wherein one of the pairs of wheels is mounted so as to ride along the lower surface of the track.

13. The playground shuttle in accordance with claim 12 including two brake elements wherein the lower wheel is positioned intermediate the brake elements, and wherein the brake elements are positioned so as to be engagable with the track lower surface to move the shuttle into the brake position and wherein the brake elements are disengagable from the track to move the shuttle into the free-roll position.

14. The playground shuttle device in accordance with claim 1 wherein the biasing element is a coil spring.

15. A playground shuttle device comprising:

a track having an upper surface and a lower surface;

a support structure connected to and supporting the track; and a shuttle for traversing along the track, the shuttle including a transport assembly having a plurality of wheels positioned so as to move the shuttle along the track, and a brake assembly operably connected to the transport assembly, the brake assembly including a biasing element extending between and connecting the brake assembly to the transport assembly, the brake assembly being movable relative to the transport assembly between a brake position wherein two brake elements, adjacent to opposite end portions of the shuttle, engage the track and a free-roll position wherein the brake elements are disengaged from the track, the brake assembly being biasedly mounted to the transport assembly to the brake position, wherein a force applied to the brake assembly against the biasing element disengages the brake elements from the track to move the shuttle to the free-roll position and wherein removal of the force from the brake assembly engages the brake elements with the track to move the shuttle to the brake position.

16. The playground shuttle device in accordance with claim 15 including three pairs of wheels positioned so as to ride along the track, two of the pairs of wheels positioned to ride along the upper surface of the track and one pair of wheels positioned to ride along the lower surface of the track, and wherein the brake assembly includes two brake elements positioned outwardly of the wheels for engaging the lower surface of the track.

17. The playground shuttle device in accordance with claim 15 including a pair of handles extending from and mounted to the brake assembly and wherein a weight applied to the handles moves the brake element out of engagement with the track and moves the shuttle into the free-roll position and wherein removal of the weight from the handles engages the brake element with the track and moves the shuttle into the brake position.

18. The playground shuttle in accordance with claim 15 wherein the brake elements are spaced outwardly of the wheels.

* * * * *